US009016382B2

(12) United States Patent
Braxton

(10) Patent No.: US 9,016,382 B2
(45) Date of Patent: Apr. 28, 2015

(54) OFFSHORE DRILLING RIG FINGERBOARD LATCH POSITION INDICATION

(75) Inventor: James R. Braxton, The Woodlands, TX (US)

(73) Assignee: Invensys Systems, Inc., Foxboro, MA (US)

( * ) Notice: Subject to any disclaimer, the term of this patent is extended or adjusted under 35 U.S.C. 154(b) by 427 days.

(21) Appl. No.: 13/413,966

(22) Filed: Mar. 7, 2012

(65) Prior Publication Data

US 2013/0032405 A1 Feb. 7, 2013

Related U.S. Application Data

(60) Provisional application No. 61/515,369, filed on Aug. 5, 2011.

(51) Int. Cl.
*E21B 7/12* (2006.01)
*E21B 19/14* (2006.01)

(52) U.S. Cl.
CPC ..... *E21B 19/14* (2013.01)

(58) Field of Classification Search
CPC ..... E21B 19/002; E21B 19/143
USPC ..... 166/352, 358, 360, 250.01, 66; 414/22.51; 211/60.1
See application file for complete search history.

(56) References Cited

U.S. PATENT DOCUMENTS 1,804,962 A * 5/1931 Thorpe ..... 211/70
2,311,933 A * 2/1943 Deckard ..... 211/70.4
2,423,169 A * 7/1947 Bennett ..... 414/22.68
2,569,928 A * 10/1951 Gonzalez ..... 222/136
2,619,234 A * 11/1952 Stone ..... 211/70.4
2,773,605 A * 12/1956 De Jarnett ..... 414/22.71
3,501,017 A * 3/1970 Johnson et al. ..... 211/70.4
3,536,937 A * 10/1970 Kenzi et al. ..... 327/365
3,701,435 A * 10/1972 Woolslayer et al. ..... 211/60.1
3,717,849 A * 2/1973 Thornton, Jr. ..... 340/3.31
3,768,663 A * 10/1973 Turner et al. ..... 211/70.4
3,799,364 A * 3/1974 Kelly et al. ..... 414/22.71
3,800,962 A * 4/1974 Ham ..... 414/22.71
4,042,123 A * 8/1977 Sheldon et al. ..... 414/22.71
4,044,895 A * 8/1977 Adair ..... 414/22.63
4,269,554 A * 5/1981 Jackson ..... 414/22.63
4,609,045 A * 9/1986 Rogers ..... 166/312
4,725,179 A * 2/1988 Woolslayer et al. ..... 414/22.65
5,331,152 A * 7/1994 Fenton ..... 250/227.11
6,543,551 B1 * 4/2003 Sparks et al. ..... 175/52
7,083,007 B2 * 8/2006 Herst ..... 175/52
7,380,614 B1 * 6/2008 Williamson et al. ..... 175/6
7,510,028 B2 * 3/2009 Welsh ..... 175/52

(Continued)

*Primary Examiner* — Matthew Buck
*Assistant Examiner* — Aaron Lembo
(74) *Attorney, Agent, or Firm* — Thomas J. Roth, Esq.

(57) ABSTRACT

A fingerboard latch assembly includes a latch configured for operational engagement with a fingerboard for lockingly retaining at least one tubular to the fingerboard. The latch is movable within a range of motion extending from at least a locked position to an unlocked position. A positioner operatively engaged with the latch is communicably couplable to a process control network (PCN), and is sized and shaped for receipt within a latch channel of the fingerboard. The positioner is configured to move the latch within the range of motion in response to signals received from the PCN, to capture position data for the latch, including the position of the latch at a plurality of points within the range of motion, and to communicate the captured position data to the PCN.

21 Claims, 11 Drawing Sheets

(56) References Cited

U.S. PATENT DOCUMENTS

| | | | | |
|---|---|---|---|---|
| 7,802,636 | B2 * | 9/2010 | Childers et al. | 175/52 |
| 8,215,888 | B2 * | 7/2012 | Tetley et al. | 414/22.62 |
| 8,317,448 | B2 * | 11/2012 | Hankins et al. | 414/22.68 |
| 8,584,773 | B2 * | 11/2013 | Childers et al. | 175/52 |
| 8,631,949 | B2 * | 1/2014 | Roodenburg et al. | 211/60.1 |
| 8,696,289 | B2 * | 4/2014 | Tetley et al. | 414/22.62 |
| 2006/0249205 | A1 * | 11/2006 | Shturman et al. | 137/505 |
| 2012/0038486 | A1 * | 2/2012 | Sinclair et al. | 340/686.1 |
| 2013/0011221 | A1 * | 1/2013 | Mcintosh et al. | 414/22.51 |
| 2013/0220600 | A1 * | 8/2013 | Bakri et al. | 166/250.01 |

* cited by examiner

OFFSHORE DRILLING RIG FINGERBOARD LATCH POSITION INDICATION

RELATED APPLICATION

This application claims the benefit of U.S. Provisional Patent Application Ser. No. 61/515,369, entitled Offshore Drilling Rig Fingerboard Latch Position Indication, filed on Aug. 5, 2011, the contents of which are incorporated herein by reference in their entirety for all purposes.

BACKGROUND

1. Technical Field

This invention relates to drilling rig fingerboards, and more particularly to a fingerboard latch assembly for providing real time latch position feedback via a process control network.

2. Background Information

Oil and gas well drilling systems include numerous types of piping, referred to generally as "tubulars". Tubulars include drill pipes, casings, and other threadably connectable oil and gas well structures. Long "strings" of joined tubulars, or drill strings, are typically used to drill a wellbore and to prevent collapse of the wellbore after drilling. The drill strings are typically stored in a structure commonly referred to as a fingerboard. Fingerboards typically include an elongated support structure(s) or "fingerboard row(s)" each capable of receiving a plurality of drill strings. Each drill string is typically individually secured to one of the finger rows by a corresponding latch, which is movable between a locked and an unlocked position. On offshore drilling rigs, these tubulars are typically stacked upright in the fingerboards, while the latches hold the tubular in place until needed.

In some fingerboards, the latches are manually moved between the locked and unlocked positions by an oil or gas well worker who walks across the fingerboards to manually move the latches to the desired locked or unlocked position. Due to the extreme height of the fingerboards, (in some instances 90 feet tall or more) the manual operation of the latches by the worker is undesirably dangerous. This practice may be particularly dangerous when the worker moves the latches between the locked and unlocked position by kicking the latches into or out of the locked position as the worker walks across the fingerboards, which is not an uncommon practice.

In an effort to make fingerboards less dangerous some manufacturers include automated latches that are pneumatically actuated. Although these latches may decrease the danger to the worker relative to the aforementioned manual approaches, they are not without drawbacks. For example, when the drilling rig operator needs to collect and use one tubular he will press a button on a control panel that will raise its latch to its unlocked position to release the tubular. However, conventional pneumatic latch controls typically do not provide feedback to the operator of the actual latch position. In some cases the latch will not raise fully and at its height on the derrick, it is generally difficult to confirm the actual position of the latch. In such a situation, a worker generally needs to climb up the derrick and walk out onto the fingerboard to determine the position of the latch. As mentioned above, the height of the fingerboard tends to make this a dangerous procedure. Moreover, in some cases the drilling rig operator will press the button again, without first determining the latch position, sending another signal in an effort to open it. This may cause the second latch behind the first to open, releasing its pipe string which may then collide with the unreleased drill pipe. This collision may damage the fingerboard making it inoperable. Since oil rigs are generally 8-10 miles off shore, service/repair of the fingerboard may be difficult and/or time consuming. Also, as a result of the collision, the pipes may be released to crash onto the rig platform below possibly harming people and causing damage.

It is also noted that by virtue of their function, any equipment used in connection with the fingerboards is prone to damage due to the relatively harsh conditions associated with the mud and salt water, such as may be carried by the tubulars as they are withdrawn from a well and placed back into the fingerboards for storage and re-use.

Thus, a need exists for a fingerboard latch actuation system that addresses drawbacks associated with the prior art.

SUMMARY

In one aspect of the present invention, a fingerboard latch assembly includes a latch configured for operational engagement with a fingerboard for lockingly retaining at least one tubular to the fingerboard. The latch is movable within a range of motion extending from a locked position to an unlocked position. A positioner operatively engaged with the latch is communicably couplable to a process control network (PCN). The positioner is configured to move the latch within the range of motion in response to signals received from the PCN, and to capture position data for the latch substantially in real time. The position data includes the position of the latch at substantially any point within the range of motion. The positioner is also configured to transmit the captured position data to the PCN, substantially in real time.

In another aspect of the invention, a fingerboard latch assembly includes a latch configured for operational engagement with a fingerboard for lockingly retaining at least one tubular to the fingerboard. The latch is movable within a range of motion extending from at least a locked position to an unlocked position. A positioner operatively engaged with the latch is communicably couplable to a process control network (PCN), and is sized and shaped for receipt within a latch channel of the fingerboard. The positioner is configured to move the latch within the range of motion in response to signals received from the PCN, and to capture position data for the latch, including the position of the latch at a plurality of points within the range of motion. The positioner is also configured to communicate the captured position data to the PCN.

In yet another aspect of the invention, a method of operating a fingerboard includes placing at least a portion of the fingerboard latch assembly of the preceding aspect of the invention within a latch channel of the fingerboard. This method further includes receiving a signal via a process control network (PCN), at the fingerboard latch assembly, and moving the latch in response to the signal, within its range of motion. The latch assembly captures position data for the latch at a plurality of points within the range of motion, and transmits the captured position data via the PCN.

The features and advantages described herein are not all-inclusive and, in particular, many additional features and advantages will be apparent to one of ordinary skill in the art in view of the drawings, specification, and claims. Moreover, it should be noted that the language used in the specification has been principally selected for readability and instructional purposes, and not to limit the scope of the inventive subject matter.

BRIEF DESCRIPTION OF THE DRAWINGS

The present invention is illustrated by way of example and not limitation in the figures of the accompanying drawings, in which like references indicate similar elements and in which.

DETAILED DESCRIPTION

Figure 1A:
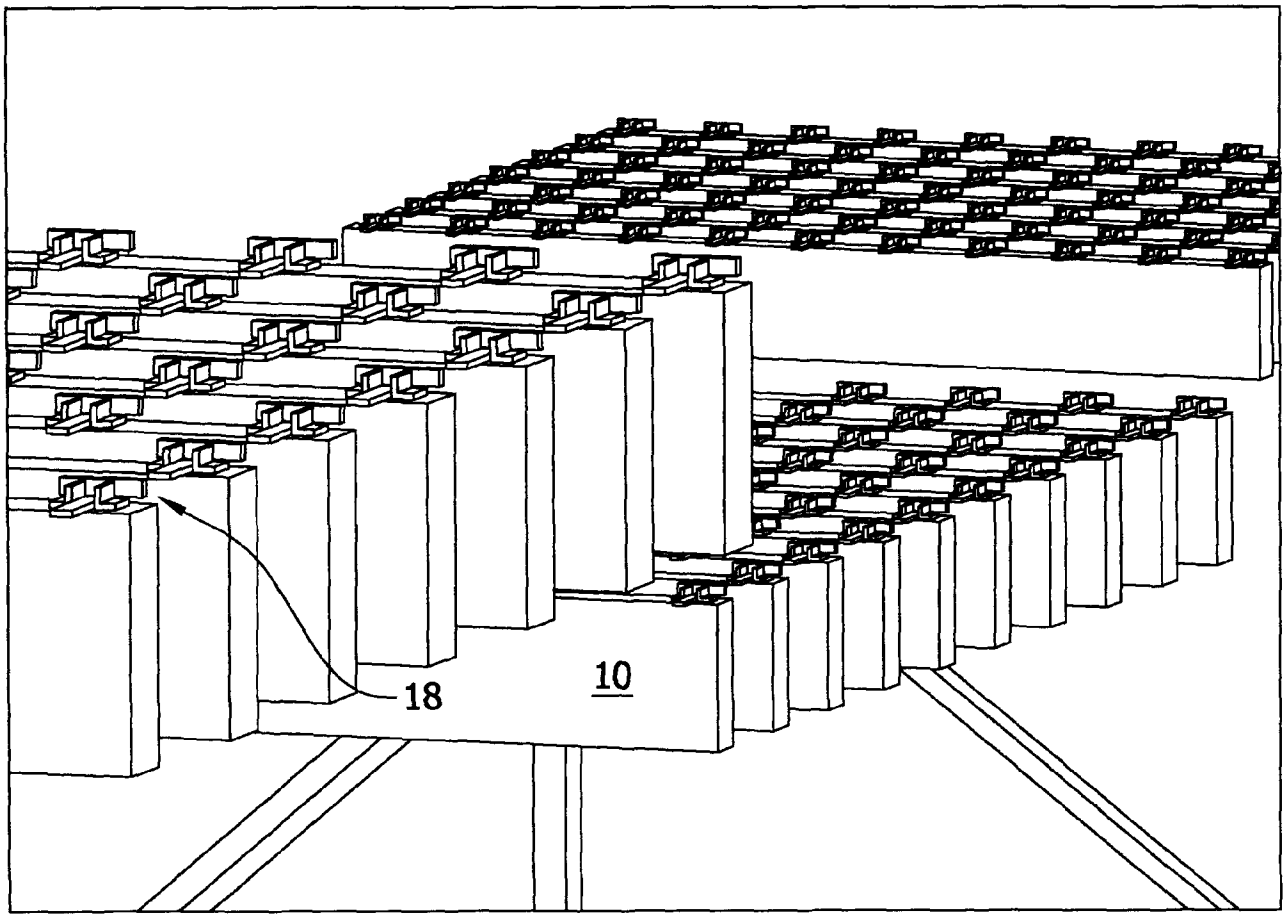
FIG. 1A is a perspective view of fingerboards on an Offshore Drilling Rig.

In the following detailed description, reference is made to the accompanying drawings that form a part hereof, and in which is shown by way of illustration, specific embodiments in which the invention may be practiced. These embodiments are described in sufficient detail to enable those skilled in the art to practice the invention, and it is to be understood that other embodiments may be utilized. It is also to be understood that structural, procedural and system changes may be made without departing from the spirit and scope of the present invention. In addition, well-known structures, circuits and techniques have not been shown in detail in order not to obscure the understanding of this description. The following detailed description is, therefore, not to be taken in a limiting sense, and the scope of the present invention is defined by the appended claims and their equivalents.

General Overview

Embodiments of the present invention control and transmit the position of automated latches on fingerboards. This is accomplished by the use of positioners mounted to latches on the fingerboard assemblies. These positioners control movement and provide feedback of a pneumatic control valve, pneumatic cylinder, and/or pneumatic piston. Operators may provide a signal/communication through a control or host system to the positioner to open and/or close the latch. In response to this control signal, the positioner will open and/or close the latch while also providing a feedback signal (e.g., electrical, pneumatic, fieldbus, resistance and/or wireless, etc.) back to the control or host system indicating the specific position of the latch, e.g., open, closed, or positions therebetween.

In the following description, for purposes of explanation, numerous specific details are set forth in order to provide a thorough understanding of the present invention. It will be evident, however, to one skilled in the art that the present invention may be practiced without these specific details.

Terminology

As used herein, the terms "fieldbus" and/or "process control network" refer to a digital, two-way, multi-drop communication link among intelligent measurement and control devices, and serves as a local area network (LAN) for advanced process control, remote input/output and high speed factory automation applications. The term 'real time' refers to sensing and responding to external events nearly simultaneously (e.g., within milliseconds or microseconds) with their occurrence, or sufficiently fast to enable the device to keep up with an external process (for example, sufficiently fast as to avoid losing data generated by the FDs).

Referring now to the Figures, embodiments of the present invention will be more thoroughly described. These embodiments are directed to fingerboards 10 (FIG. 1A) for storing a plurality of threaded tubulars 14 (FIG. 1B). Each fingerboard 10 has a plurality of latches 18 for securing the threaded tubulars to the fingerboard. Each latch may include a pneumatic cylinder 22 (FIG. 3) that is pneumatically actuatable to move a latch finger between a locked (closed) position and an unlocked (open) position. In the closed position, the latch secures a corresponding threaded tubular to the fingerboard. When the latch is moved to its open position, a corresponding threaded tubular may be removed from the fingerboard.

Figure 1B:
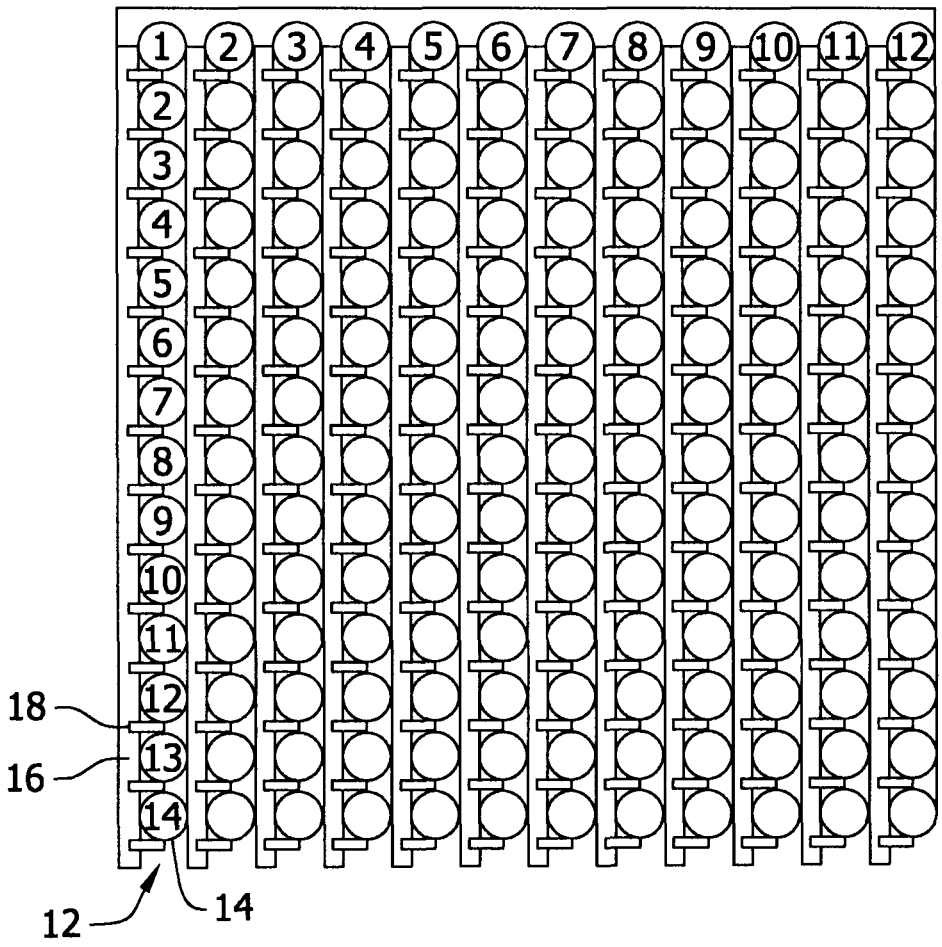
FIG. 1B is a top view of an array of fingerboard(s) of FIG. 1A.
Figure 2:
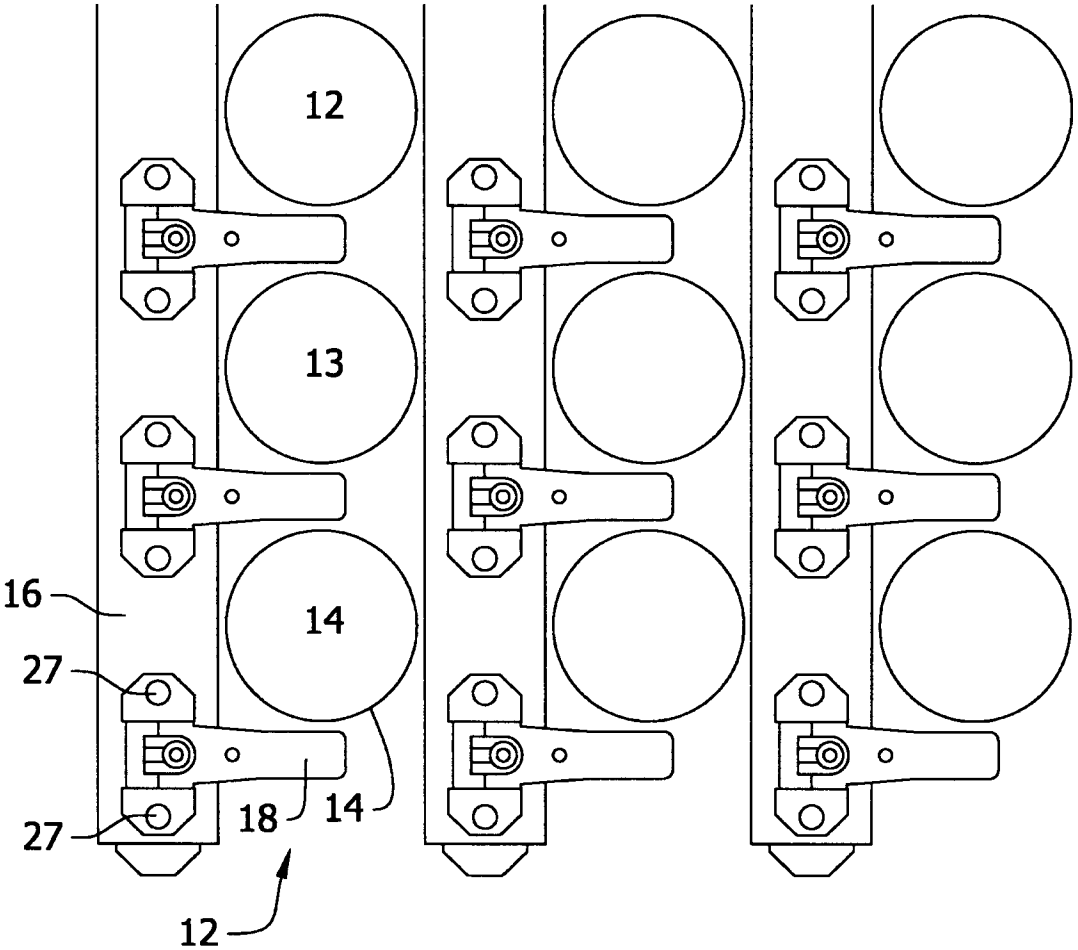
FIG. 2 is an enlarged view of a portion of the array of fingerboard(s) of FIG. 1B.

As best shown in FIGS. 1A, 1B, and 2, fingerboards 10 according to one embodiment of the present invention, include a plurality of elongated support structures 12 (hereinafter fingerboard rows 12) each capable of receiving a plurality of threaded tubulars 14. Each fingerboard row 12 includes adjacent structures (fingers) 16, laterally spaced apart to receive the plurality of threaded tubulars 14 therein. In the depicted embodiment, each fingerboard row 12 receives fourteen threaded tubulars 14. However, in other embodiments each fingerboard row 12 may receive any appropriate number of threaded tubulars 14. Note that the numbers one through fourteen on the threaded tubulars shown in the leftmost fingerboard row 12 of FIG. 1B and the numbers one through twelve on the uppermost threaded tubular in each fingerboard row 12 are merely shown for reference purposes.

As mentioned above, each fingerboard row 12 includes a plurality of corresponding latches 18. Latches 18 may be substantially any fingerboard latch known to those skilled in the art, as may be modified in accordance with the teachings of the present invention. In the depicted embodiment, each latch 18 secures a corresponding threaded tubular 14 within its corresponding fingerboard row 12. However, in other embodiments each latch 18 may be used to secure more than one threaded tubular 14 to the fingerboard row 12.

Figure 3:
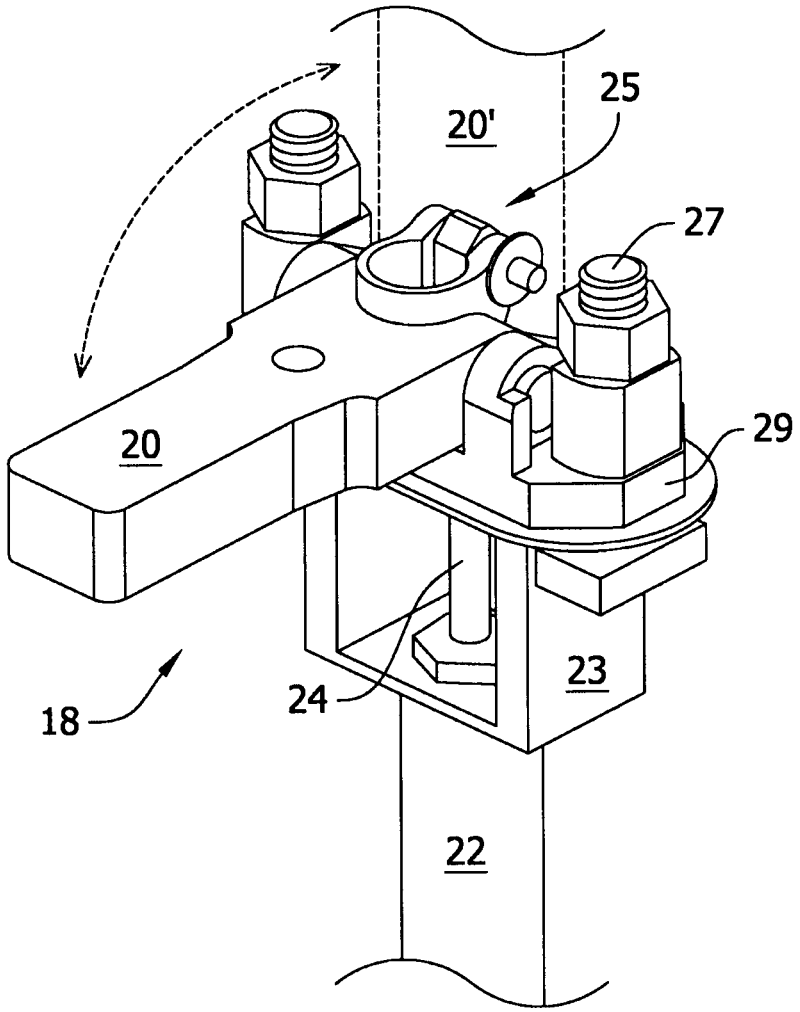
FIG. 3 is a perspective view, with portions shown in phantom to designate movement, of a latch usable with embodiments of the present invention.

Turning now to FIG. 3, each latch 18 includes an arm 20, which is pivotably mounted to a yoke 23, for movement between its locked/closed position as shown (as also shown in FIGS. 1B and 2) and its unlocked/open position as shown in phantom at 20'. In the locked position, the latch 18 engages its corresponding threaded tubular 14 (FIG. 2) to secure the threaded tubular 14 within a fingerboard row 12. In the unlocked position, the latch 18 disengages its corresponding threaded tubular 14 to allow the threaded tubular 14 to be removed from its fingerboard row 12. In the unlocked position, the latch 18 also allows for the insertion of the threaded tubular 14 into its corresponding fingerboard row 12, where it may then be secured by moving the latch 18 from the unlocked position to the locked position.

Figure 4:
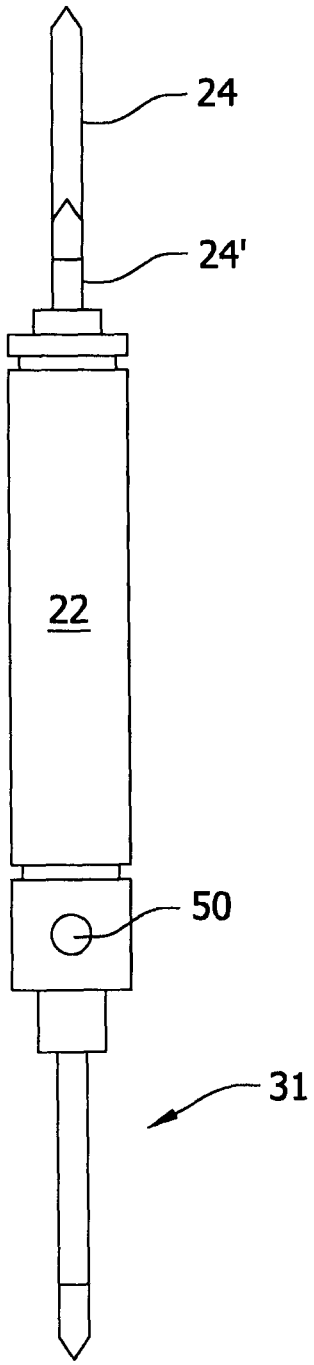
FIG. 4 is a perspective view of a pneumatic cylinder usable with various embodiments of the present invention.

As shown, latch 18 may be moved between the locked and unlocked positions by a pneumatic cylinder 22 configured to mechanically actuate (pivot) the latch arm 20 between the locked and unlocked positions. For example, as best shown in FIG. 4, in the particular embodiments shown and described herein, a piston 24 of cylinder 22 is extended when in the unlocked position, and retracted when in the locked position as shown at 24'. The end of piston 24 may thus be pivotably coupled to the arm 20 in any convenient manner, such as with a mechanical linkage 25 as shown in FIGS. 3 and 6A-6D, to effect the described locking and unlocking.

Figure 5:
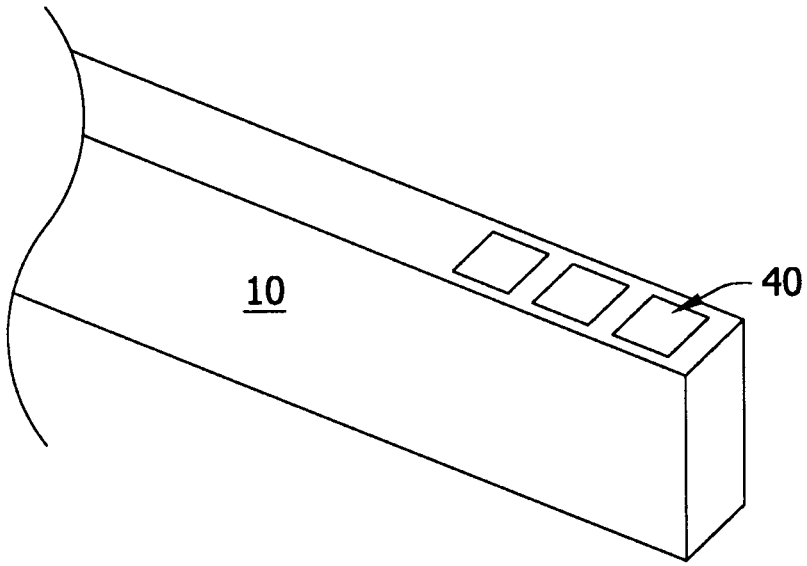
FIG. 5 is a perspective view of a portion of a fingerboard including latch channels within which embodiments of the present invention may be installed.
Figures 6A, 6B, 6C, 6D:
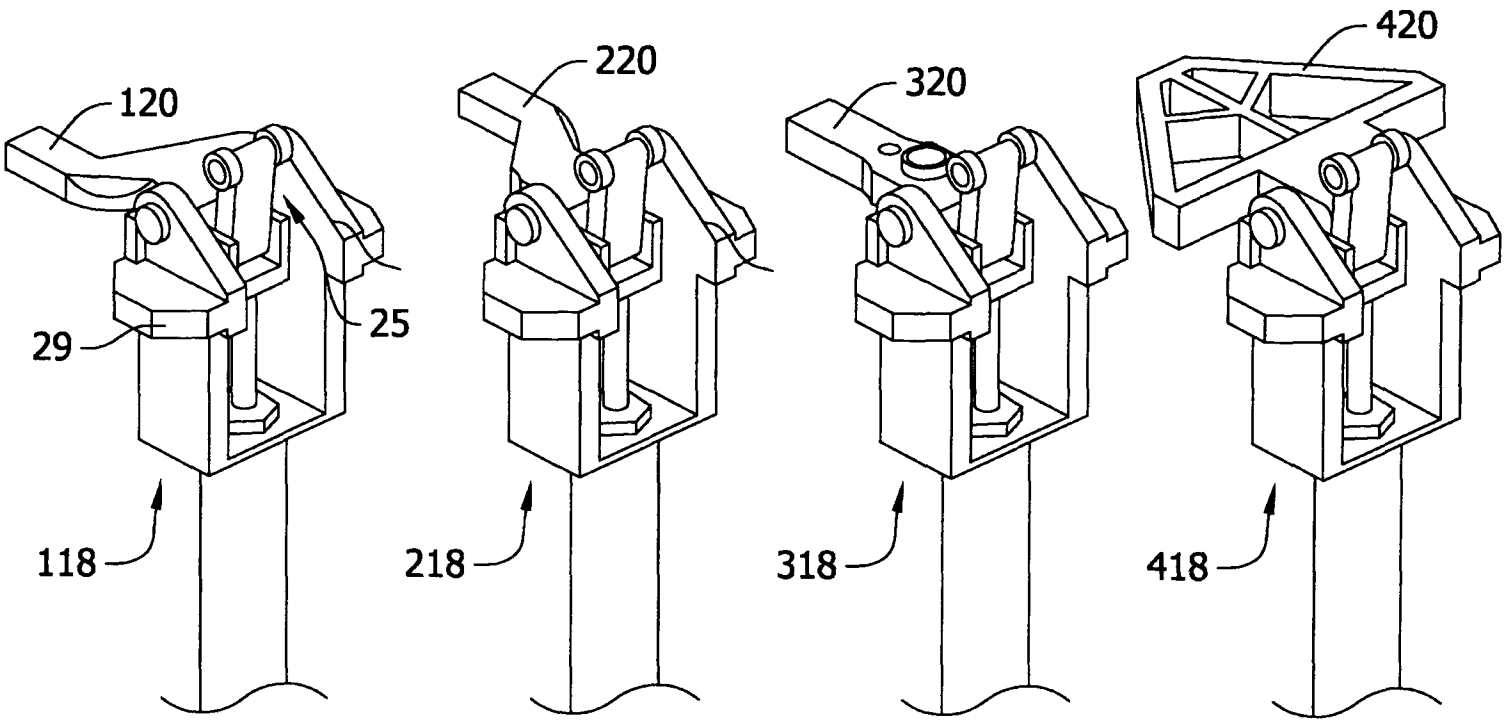
FIGS. 6A-6D are perspective views of various alternate latches usable with embodiments of the present invention.

Each latch 18 may be mounted to its corresponding fingerboard row 12 using substantially any desired mechanical fastening means, such as riveting, threaded fasteners (as shown), welding, press fit, or any combination thereof. In the depicted embodiment, each latch 18 may be secured to its corresponding fingerboard row 12 by inserting a portion thereof into an opening (latch channel) 40 (FIG. 5) in the fingerboard row 12. In the embodiment shown, yoke 23 is sized and shaped for receipt within the similarly sized and shaped latch channel 40, e.g., up to flange portion 29 thereof. Each latch 18 may thus be inserted into latch channel 40 until the flange 29 engages an upper surface of the fingerboard 12. Once this full insertion is reached, each latch 18 may be secured to the fingerboard row 12 by one or more of the aforementioned mechanical fastening means, such as threaded fasteners 27 passing through flange 29 as shown.

It should be recognized that the latches of substantially any configuration may be used in various embodiments of the present invention. Non-limiting examples of various latches that may be modified as taught herein for use in embodiments of the present invention are shown at 118, 218, 318 and 418 in FIGS. 6A-6D. These latches may all include pneumatic cylinders as shown and described hereinabove, though substantially any other actuation devices known to those skilled in the art, including electrically and/or hydraulically operated devices, may be used without departing from the scope of the present invention. As shown, the latches of FIGS. 6A-6D are substantially similar to one another but for the use of latch arms 120, 220, 320, and 420, of various sizes and shapes as may be desired for various applications.

Figure 7:
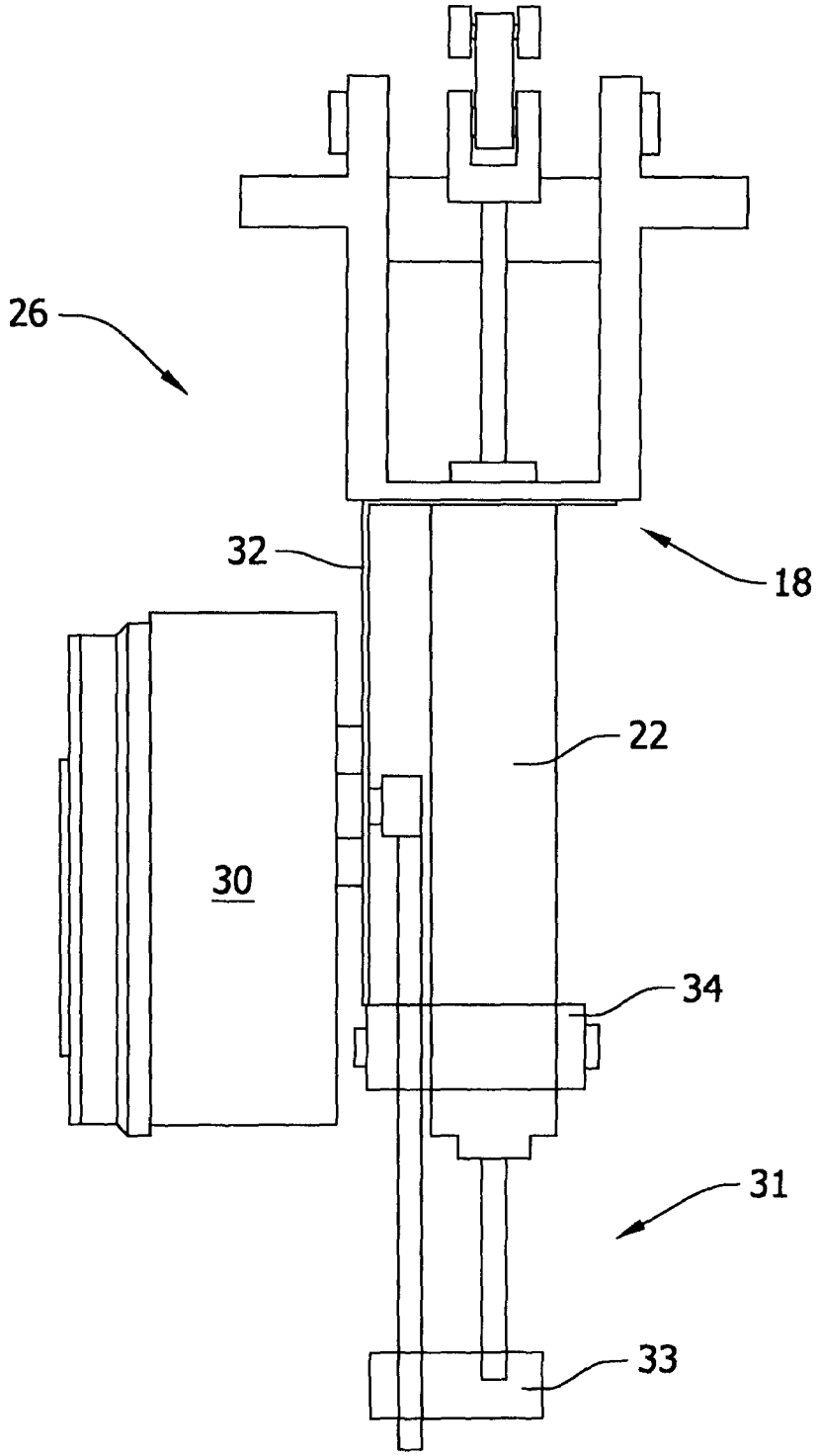
FIG. 7 is an elevational assembly drawing of an embodiment of a latch assembly of the present invention.

Turning now to FIG. 7, an embodiment of the present invention includes a latch assembly 26 having a latch 18, as discussed hereinabove, which is equipped with a positioner 30, such as the SRD991 pneumatic positioner available from Invensys Systems, Inc. (Foxboro, Mass.). As shown, the positioner 30 is fastened, via an L-bracket 32, onto the latch 18, e.g., with a clamp 34 extending circumferentially about the pneumatic cylinder 22. As also shown, the piston 24 at one end of cylinder 22 is pivotably coupled to mechanical linkage 25, while the other end 31 of the cylinder is secured to ground 33.

Figure 8:
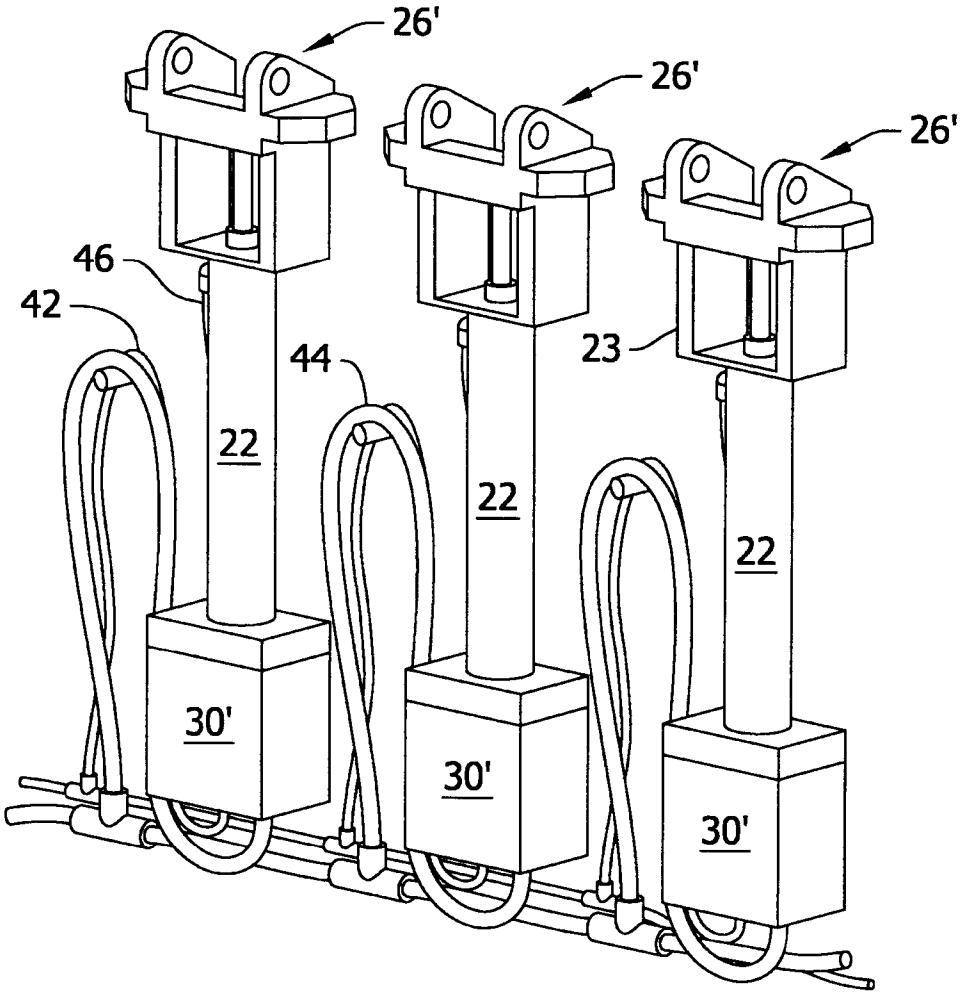
FIG. 8 is a perspective view of a plurality of examples, networked to one another, of an alternate embodiment of the present invention, with portions removed for clarity.
Figure 9A:
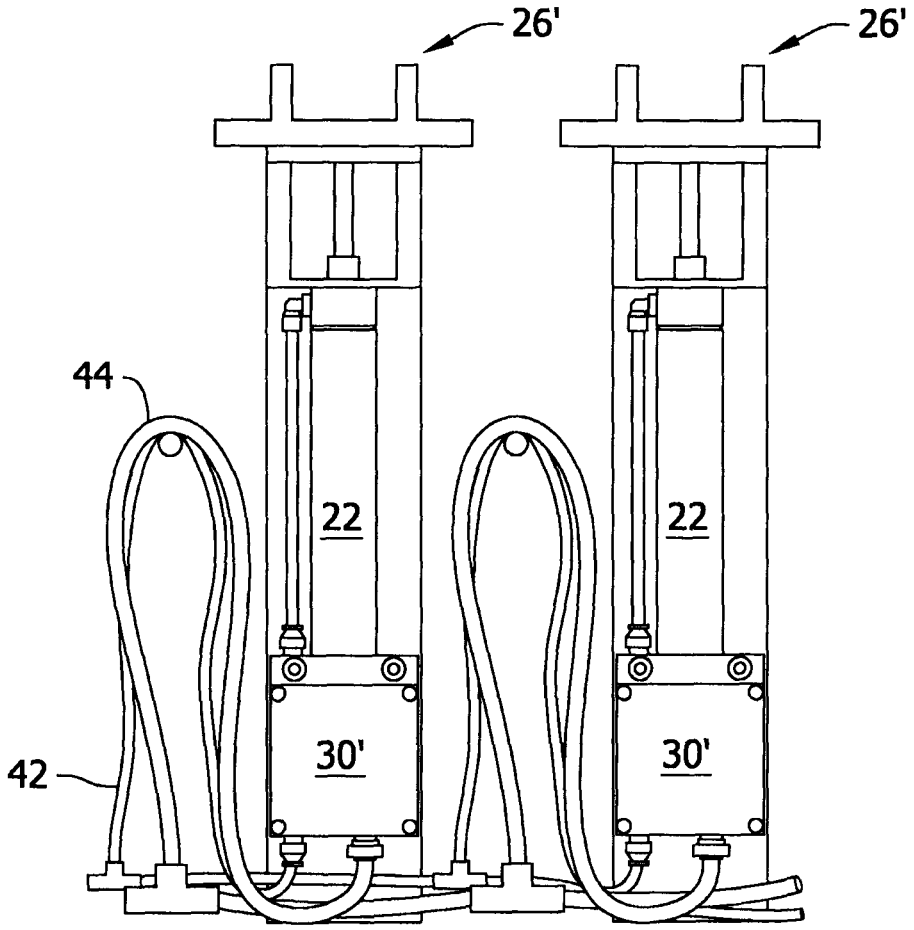
FIG. 9A is a front elevational view of a portion of the view of FIG. 8.
Figure 9B:
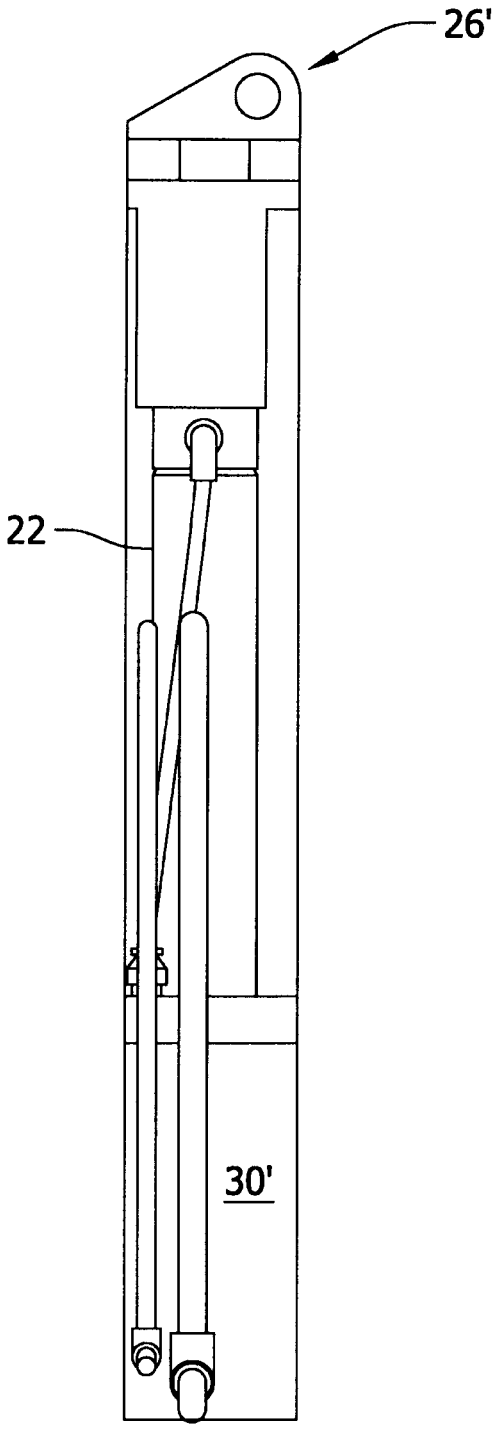
FIG. 9B is a side elevational view of the embodiment of FIG. 9A.

Turning now to FIGS. 8-9B, an alternate embodiment of the present invention, shown as latch assembly 26', includes a modified positioner 30'. A plurality of assemblies 26' are shown linked to one another in series, e.g., as in a typical installation within a fingerboard 10 (FIGS. 1A-2). The pivot arms 20 (FIG. 3) have been omitted from these figures for clarity. In this embodiment, positioner 30' may include the aforementioned SRD991, as modified to fit into a box at the (e.g., bottom) end 31 of the cylinder latch opposite the yoke 23, to provide a relatively compact assembly sized and shaped to fit within the latch channel 40 (FIG. 5) of a conventional fingerboard 10, as discussed hereinabove. This mounting configuration effectively houses the positioner 30' within the fingerboard 10 to help protect the positioner 30' from the relatively harsh environmental conditions associated with oil rig operation, as mentioned hereinabove. Positioner 30' is substantially similar to positioner 30 shown and described hereinabove, though it may be modified to exclude the onboard display/user interface common to commercial versions of the SRD991. Instead, one or more ports (not shown) may be provided to enable users to plug a portable display/user interface into the assembly 26', e.g., for initial setup and/or diagnostics. Alternatively, setup and diagnostics may be accomplished remotely, e.g., via a process control network (PCN) connection 42 as discussed below.

As also shown, PCN and pneumatic supply lines 42 and 44, which in particular embodiments are routed within the fingerboards 10, are connected to the positioners 30'. A pneumatic line 46 pneumatically connects each positioner 30' to its respective cylinder 22. Thus, in the embodiment shown, lines 42, 44 and 46 are all configured for being disposed within the fingerboards 10, to help protect them from the harsh environmental conditions.

In the various embodiments shown and described herein, the positioner 30, 30' is configured to provide feedback to the user to indicate not only when each latch 18, 118, etc., is disposed in its locked and unlocked positions, but to also indicate the position of the latch at a plurality of points within its range of motion between the locked and unlocked positions. This feedback may be provided using one or more position sensors 50 (FIG. 4). In particular embodiments, sensor(s) 50 may include one or more limit switches used to confirm particular discrete positions of the latch, e.g., at either end (locked and unlocked positions) and/or midrange positions within its range of motion. Sensor(s) 50 may also include one or more potentiometers, such as may be disposed internally to the cylinder 22, to provide a signal corresponding to substantially any position with the range of motion of the latch. In particular embodiments, the potentiometer(s) may be a conventional resistive (analog) device, configured to generate a signal which may be converted by the positioner into a digital signal suitable for transmission via the PCN line 42. Moreover, a combination of potentiometer and limit switches may be used, e.g., with the limit switch(es) used to calibrate the potentiometer(s). It should be recognized that substantially any type of sensor(s) known to those skilled in the art may be used in these embodiments, without departing from the scope of the present invention. However, particular embodiments use sensors configured to directly engage moveable portions of the latch. Such direct engagement may be effected in either a contact or non-contact manner, e.g., using conventional limit switches, and/or using non-contact devices such as conventional inductive, capacitive, magnetic, and photoelectric sensors, and the like. Moreover, in particular embodiments, the sensor(s) 50 is disposed for being housed within the latch channel along with the positioner 30' and a portion of the latch 18, 118, etc., such as by placing sensor 50 internally to the cylinder 22 as described hereinabove.

It should be noted that the positioners 30, 30' may be configured to communicate via network connection 42 using substantially any communication protocol known to those skilled in the art of industrial automation. Examples of protocols that may be used include Profibus, ModBus, FOUNDATION fieldbus, HART, Ethernet, and conventional 4-20 ma analog signal, etc., and combinations thereof. Moreover, both wired and wireless protocols may be used, as well as non-electrical (e.g., pneumatic) signaling approaches. In this regard, although network connection 42 is shown as a hardwired electrical connection, substantially any type of connection known to those skilled in the art, including wireless or non-electrical (e.g., pneumatic) connections may be used without departing from the scope of the present invention. In particular embodiments, the positioners 30, 30' may be configured to transmit latch position data via PCN 42 substantially in real time, e.g., to provide substantially real time position information to the PCN operator. The positioners 30, 30' may push this information to the network 42, and/or may provide this real time information in response to requests sent via the PCN.

Having described exemplary embodiments of latch assemblies of the present invention, an exemplary method in accordance with the present invention will be described with reference to the following Table I. As shown therein, at 70, at least a portion of a fingerboard latch assembly 26, 26', etc., is received within a latch channel of a fingerboard. At 72, the fingerboard latch assembly receives a signal via the PCN. At 74, the latch is moved in response to the signal, and position data for the latch is captured 76 at a plurality of points within its range of motion. At 78, the latch assembly transmits the captured data via the PCN.

Optional aspects of this method are shown at 80-86 of Table II, and include 80 capturing position data at substantially any point within the range of motion; 82 capturing position data using a potentiometer; 84 disposing the positioner within the latch channel; and 86, effecting the capturing 76 and transmitting 78 substantially in real time.

TABLE I

| | |
|---|---|
| 70 | Fingerboard latch assembly disposed within a latch channel; |
| 72 | Signal received at fingerboard latch assembly; |
| 74 | Latch moved in response to signal, within range of motion; |
| 76 | Latch position data captured at a plurality of points within the range of motion; |
| 78 | Position data transmitted via PCN. |

TABLE II

| | |
|---|---|
| 80 | capture position data at substantially any point within the range of motion |
| 82 | capture position data using a potentiometer |
| 84 | dispose the positioner within latch channel |
| 86 | capturing 76 and transmitting 78 substantially in real time |

In the preceding specification, the invention has been described with reference to specific exemplary embodiments for the purposes of illustration and description. It is not intended to be exhaustive or to limit the invention to the precise form disclosed. Many modifications and variations are possible in light of this disclosure. It is intended that the scope of the invention be limited not by this detailed description, but rather by the claims appended hereto.

It should be further understood that any of the features described with respect to one of the embodiments described herein may be similarly applied to any of the other embodiments described herein without departing from the scope of the present invention.

Having thus described the invention, what is claimed is:

1. A fingerboard latch assembly comprising:

a latch configured for operational engagement with a fingerboard for lockingly retaining at least one tubular to the fingerboard;

the latch being movable within a range of motion extending from a locked position to an unlocked position;

a positioner operatively engaged with the latch, the positioner being communicably couplable to a process control network (PCN);

the positioner configured to move the latch within the range of motion in response to signals received from the PCN;

the positioner configured to sense a plurality of positions of the latch between the locked position and the unlocked position substantially in real time; and the positioner further configured to transmit a signal representing a sensed one of the plurality of positions of the latch to the PCN, substantially in real time.

2. A fingerboard latch assembly comprising:

a latch configured for operational engagement with a fingerboard for lockingly retaining at least one tubular to the fingerboard;

the latch being movable within a range of motion extending from at least a locked position to an unlocked position;

a positioner operatively engaged with the latch, the positioner being communicably couplable to a process control network (PCN);

the positioner sized and shaped for receipt within a latch channel of the fingerboard; the positioner configured to move the latch within the range of motion in response to signals received from the PCN;

the positioner configured to capture position data for the latch, the position data including the position of the latch at the locked position, the unlocked position, and at least one position therebetween; and the positioner further configured to communicate the captured position data to the PCN.

3. The assembly of claim 2, wherein the positioner is configured to capture the position data at substantially any point within the range of motion.

4. The assembly of claim 2, wherein the positioner is configured to capture and communicate the position data substantially in real time.

5. The assembly of claim 2, wherein the latch is pneumatically actuatable.

6. The assembly of claim 5, wherein the positioner is configured to selectively couple a pneumatic fluid source to the latch.

7. The assembly of claim 2, comprising at least one sensor configured to generate the position data.

8. The assembly of claim 7, wherein the at least one sensor comprises a potentiometer.

9. The assembly of claim 7, wherein the at least one sensor comprises a plurality of limit switches.

10. The assembly of claim 7, wherein at least a portion of the latch is sized and shaped for receipt within the correspondingly sized and shaped latch channel in the fingerboard, so that the portion of the latch is housed within the fingerboard.

11. The assembly of claim 10, wherein the positioner is sized and shaped for being received within the latch channel with the portion of the latch, so that both the positioner and the portion of the latch are housed within the fingerboard.

12. The assembly of claim 11, wherein the at least one sensor is configured for being received within the latch channel with the portion of the latch, so that both the positioner and the at least one sensor are housed within the fingerboard.

13. The assembly of claim 12, wherein the at least one sensor is configured for direct engagement with the latch.

14. The assembly of claim 13, wherein the latch comprises a pneumatic piston and the at least one sensor includes a potentiometer engaged with the piston.

15. The assembly of claim 2, wherein the positioner is configured to communicate with the PCN using at least one protocol selected from the group consisting of Profibus, ModBus, FOUNDATION fieldbus, HART, Ethernet, 4-20 ma analog signal, and combinations thereof.

16. A method of operating a fingerboard, comprising:

(a) disposing at least a portion of the fingerboard latch assembly of claim 2 within a latch channel of the fingerboard;

(b) receiving a signal via a process control network (PCN), at the fingerboard latch assembly;

(c) moving the latch in response to the signal, within its range of motion;

(d) capturing, with the latch assembly, position data for the latch at a plurality of points within the range of motion; and (e) transmitting the captured position data via the PCN.

17. The method of claim 16, wherein said capturing (d) further comprises capturing position data at substantially any point within the range of motion.

18. The method of claim 17, wherein said capturing (d) further comprises capturing position data using a potentiometer.

19. The method of claim 16, wherein said disposing (a) further comprises disposing the positioner within the latch channel.

20. The method of claim 16, wherein said capturing (d) and transmitting (e) is effected substantially in real time.

21. The assembly of claim 2 wherein the positioner comprises a position sensor configured to capture position data for the latch, the position sensor directly engaging at least one movable portion of the latch.

* * * * *